US011849806B1

(12) United States Patent
Baker

(10) Patent No.: US 11,849,806 B1
(45) Date of Patent: Dec. 26, 2023

(54) SHOE

(71) Applicant: Scott Baker, Sherman Oaks, CA (US)

(72) Inventor: Scott Baker, Sherman Oaks, CA (US)

( * ) Notice: Subject to any disclaimer, the term of this patent is extended or adjusted under 35 U.S.C. 154(b) by 0 days.

(21) Appl. No.: 18/115,613

(22) Filed: Feb. 28, 2023

Related U.S. Application Data

(62) Division of application No. 16/267,130, filed on Feb. 4, 2019, now abandoned.

(51) Int. Cl.

| | |
|---|---|
| ***A43B 3/26*** | (2006.01) |
| ***A43B 23/02*** | (2006.01) |
| ***A43B 3/24*** | (2006.01) |
| ***A43B 3/02*** | (2006.01) |
| ***A43C 11/12*** | (2006.01) |
| ***A43B 23/04*** | (2006.01) |
| *A43B 5/00* | (2022.01) |

(52) U.S. Cl.
CPC ..... *A43B 23/0245* (2013.01); *A43B 3/02* (2013.01); *A43B 3/242* (2013.01); *A43B 3/26* (2013.01); *A43B 23/047* (2013.01); *A43C 11/12* (2013.01); *A43B 5/00* (2013.01)

(58) Field of Classification Search
CPC ..... A43B 23/047; A43B 3/242; A43B 3/26
See application file for complete search history.

(56) References Cited

U.S. PATENT DOCUMENTS

| | | | | | |
|---|---|---|---|---|---|
| 1,211,127 | A * | 1/1917 | Fox | A43B 23/047 | 36/51 |
| 3,040,454 | A * | 6/1962 | Topper | A43B 23/047 | 69/21 |
| 3,389,481 | A * | 6/1968 | England | A43B 3/26 | 36/97 |
| 3,765,409 | A * | 10/1973 | Merkle | A43B 3/02 | 36/89 |
| RE34,661 | E * | 7/1994 | Grim | A43B 7/20 | 128/DIG. 20 |
| 9,516,920 | B1 * | 12/2016 | DeRose | A43B 3/26 | |
| 10,178,893 | B1 * | 1/2019 | Baker | A43B 23/0245 | |
| 10,779,607 | B1 * | 9/2020 | Chandel | A43B 13/141 | |
| 2004/0107604 | A1 * | 6/2004 | Ha | A43B 3/26 | 36/97 |
| 2005/0126044 | A1 * | 6/2005 | Langley | A43B 19/00 | 36/89 |
| 2010/0199522 | A1 * | 8/2010 | Hwang | A43B 23/047 | 36/102 |
| 2012/0180338 | A1 * | 7/2012 | Lin | A43B 9/02 | 36/56 |
| 2015/0173449 | A1 * | 6/2015 | Weitzman | A43B 3/04 | 36/102 |
| 2018/0235312 | A1 * | 8/2018 | Hanft | A43B 13/16 | |
| 2020/0268106 | A1 * | 8/2020 | Blanche | A43B 11/00 | |

* cited by examiner

*Primary Examiner* — Marie D Bays

(57) ABSTRACT

A shoe comprises a sole having an upper surface and a lower surface, and a top member having an outer surface and an inner surface and mounted on the sole. The top member and sole to together define a space for receiving a foot, and the top member further comprises an opening. A fastener is provided in the top member and extends from the opening and continues over the top member such that a portion of the top member is movable between a first position in which the space is substantially closed and a second position in which a portion of the top member is folded back from the sole to provide access to the space, and further comprising areas with controllable expansion to accommodate an ankle or foot brace.

2 Claims, 26 Drawing Sheets

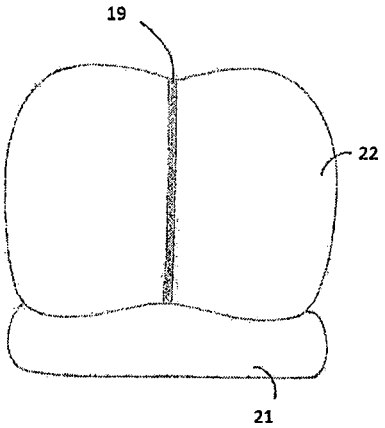
FIG. 11
FIG. 12
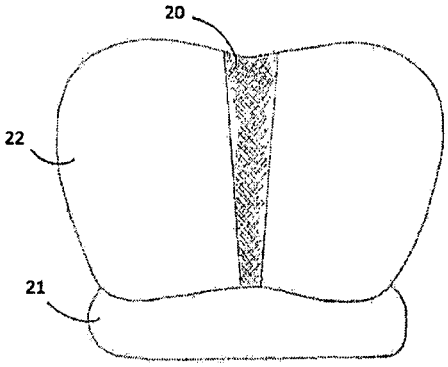

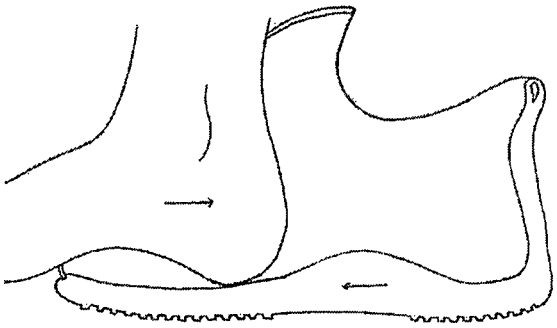
FIG. 16A
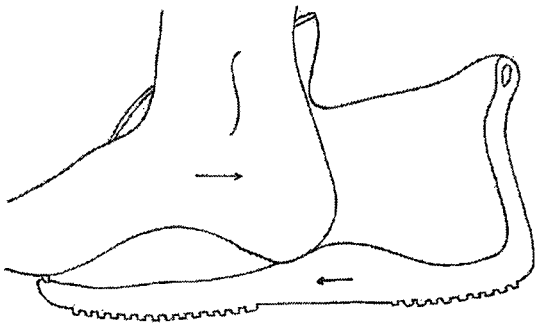
FIG. 16B
FIG. 16C
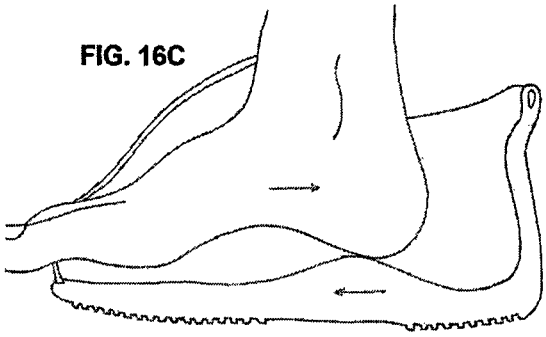
FIG. 16D
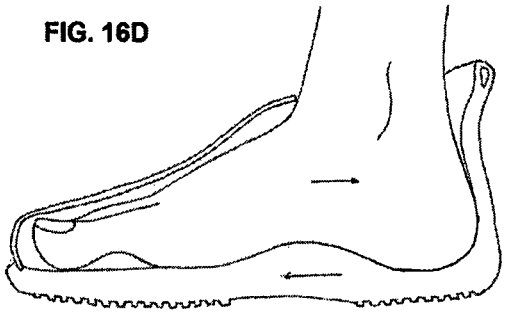

SHOE

CROSS REFERENCE TO RELATED APPLICATIONS

This application is a Divisional of U.S. patent application Ser. No. 16/267,130 filed Feb. 4, 2019, the contents of which are incorporated by reference herein in their entirety.

FIELD AND BACKGROUND OF THE INVENTION

This invention relates to a shoe. More particularly, the invention relates to a shoe which is configured and constructed so that it may be placed on the foot of the wearer in a more convenient manner. While the invention may be used in many applications, and certainly has a mainstream use for all or most people, its particular construction may be of special benefit to handicapped or disabled people. In this regard, the invention offers a simpler and more natural way to place the foot within the shoe, and may be advantageous for people who have a reduced response to touch on the foot, or a loss of muscular control in the foot, are paralyzed at the foot, or have other medical issues with their feet that require them to wear a foot, ankle, or lower leg brace.

A conventional closed shoe comprises a sole and a top member stitched or otherwise fastened to the sole. The top member will typically create a chamber or housing area for the foot, and have an opening through which the foot accesses the chamber. In many shoes, the opening may be of adjustable size so that it can be larger when inserting the foot, and reduced in size when the foot is inside the shoe. The opening is adjusted by the user by means of shoelaces, hook and loop straps or elasticized portions around the opening, to name some examples.

The opening in the top member of a conventional shoe is positioned such that the foot must be inserted into the chamber or housing area for the foot through the opening toes first, followed by the remainder of the foot and then the heel is pushed down into the shoe until it contacts the sole. In many cases, this will work well and the average person is able to position and wiggle the toes and foot so that it is properly contained within the generally snug fitting chamber or housing. However, the wearer must have the capacity and ability to flex and move the foot and toes to put on the conventional shoe. This may be a particular challenge for a person who may have muscular weakness of the foot or legs or is in fact paralyzed with no feeling or functional movement in their feet or toes, or those with conditions that require a medical brace for toe, foot, or ankle stability, the aforementioned braces require additional accommodating space in certain areas of the shoe for entry. While a conventional shoe can be large enough to allow a brace to enter the shoe the size required to accommodate a brace would be too large in all the other areas of the shoe. While most people take for granted the ability to use the foot as necessary to put on a shoe, there are many who lack this ability due to foot paralysis or some other medical condition, or young age, and conventional shoes with the type of opening as described above will therefore be difficult to navigate. It is conceivable that a person with a paralyzed foot may be able to squeeze the foot into the shoe, however without the ability to control and straighten their toes when pushing a foot into a shoe would end up with toes being bent over or twisted, the user not even knowing this would nevertheless have to deal with possible consequences including reduced circulation and swelling, swelling which leads to a further reduction in circulation, potential pain, and a deterioration of extremity health. The longer the foot is in an unnatural position the worse the condition becomes.

This invention allows for the entire front and top of the shoe to open up and out of the way thus allowing the wearer to slide the front of the shoe across the bottom of the foot starting at the wearer's heel and moving towards the toes. By moving the shoe in this direction, it automatically maintains the toes in the correct and flat and natural position, which is essential for proper circulation and continued health of the foot, additionally the invention has several areas that are self-expanding and several areas that are wearer adjustable allowing the correct size shoe for the wearer's foot to also expand only in the areas needed for where a brace would be positioned inside the shoe once the shoe is closed.

SUMMARY OF THE INVENTION

According to one aspect of the invention, there is provided a shoe comprising: a sole having an upper surface and a lower surface; a top member having an outer surface and an inner surface and mounted on the sole, the top member and sole defining a space for receiving a foot, the top member further having a foot entry opening; a fastener in the top member extending from the foot entry opening and continuing over the top member such that a portion of the top member is movable between a first position in which the space is substantially closed and a second position in which a portion of the top member is folded back from the sole to provide complete access to the space; and self-expanding areas in different locations of the top member to accommodate different toe, foot, and ankle braces.

In one embodiment, the foot entry opening in the top member is located at one end of the shoe and sized so as to permit the leg or ankle of the wearer to extend therethrough. The fastener may comprise a zipper, a hook and loop fastener, a combination thereof, or some other structure such as a snap.

Preferably, the fastener commences in the top member at the opening thereof, extends from the opening towards the sole near the front of the shoe, continues around the front of the top member near the junction of the top member and sole and continues in the top member partially along the opposite side of the shoe.

In one embodiment the top member of the shoe can also incorporate several self-expanding areas on the top member from the toe area towards the foot opening area, these expanding areas allow for braces that cover the top of the wearer's toes and only expand around where the brace needs additional room thus not requiring a completely larger size shoe that the wearer requires.

In another embodiment the top member of the shoe can also incorporate a self-expanding vertical strip in the center of the heel portion of the top member allowing for accommodating an ankle brace, additionally incorporating a lacing around the foot opening to control the heel expansion once the brace is in place inside the shoe.

In yet another embodiment the top member of the shoe can also incorporate an additional vertical lacing on the opposite side of the foot opening from the zipper fastener opening position allowing for a more specialized type of brace to be utilized inside the shoe.

In another embodiment the top member has vertical expandable areas on either one or both sides of the foot opening area as well as a securement cover flap for each expandable area which enhances structural stability into the upper edge of the foot opening.

In still another embodiment, the shoe has a heel end, a generally opposite front end, an inner side and an outer side, the opening being located near the heel end, the fastener commencing in the top member at the opening thereof, extends from the opening toward the sole near the front end of the shoe, and continues in the top member around the front end thereof and partially along the opposite side of the shoe.

In still another embodiment the shoe being a tall boot style and facilitating the entire top section of the foot area and up the tall portion of the front and side of the boot opening up and moving off to one side like a flap there is also on one or both sides an expandable area from the sole to above the ankle position area that allows for the wearer to have their brace accommodated for, each expandable area having a cover flap that enhances support to the expanded area once the boot style shoe is in the fastened and closed position and on the wearers foot.

The shoe may comprise many different styles, from boot styles to sneakers styles, and from high heels to casual dress, all of which can utilize one of many fastener options from a zipper to a hook and loop material, the fastening means can be exposed or hidden and the pull tab can be strictly utilitarian or expressingly decorative, furthermore many of these aforementioned styles of shoes can also incorporate laces for further adjusting the fit or for additional fashion.

This invention therefore relates to a shoe with a unique structure and configuration which enables it to be placed on the foot and removed therefrom in a more convenient manner which also facilitates healthy and natural foot and toe placement while also accommodating several types of foot, ankle, and toe support braces.

The invention provides for a shoe having a base or sole, a top mounted on the sole so that sole and top together define a space for receiving a foot, an opening on the top, and fastening means whereby at least a part of the top may be selectively separated from the sole to allow the foot to be inserted into or removed from the shoe, and fastened to the sole when the foot is in the space defined by the shoe so as to keep the foot securely within the space.

For the most part, when a person puts on shoes, he or she without even giving it much conscious thought is holding their toes out straight and sliding the foot into the shoe. Without muscular control, the toes are likely to bend under, fold and bind. When the toes are in a folded position, the entire skeletal structure of the foot must make adjustments. An inherent problem in this regard is the restricted circulation of blood that may occur, and with this restriction comes the swelling of tissue. These conditions may have a domino or compounding effect, in that the more the foot swells, the more restriction is likely, in turn producing yet more swelling. This of course leads to the diminished health of the foot, and the various tissues and components which form it.

When placing the heel of the foot on the sole of a shoe at the front of an open shoe constructed in accordance with the present invention and sliding the shoe forward and/or the foot backward, this action directs the toes to lay out in a flat and normal healthy position, thus maintaining unimpaired circulation and not resulting in any swelling, both of which can occur in conventional shoes with conventional entry procedures. In one embodiment, the zipper when closed is designed to be on one side of the shoe at the opening that encircles the ankle (using the low rise style of shoe as an example in this case), and the zipper tab is pulled at an angle towards the front of the shoe where the top member connects to the sole, around the front of the shoe, and toward and along the other side of the shoe. The zipper and zipper tab can be conveniently located on any part of the shoe so as to give effect to the purpose of the present invention, namely, to move at least a part of the top of the shoe away from the base or sole to provide easy access to the space when inserting the foot into the shoe. As long as the front of the shoe is opened up for heel entry, as will be described further below, the precise positioning of the zipper or other mechanism to effect opening and closing may vary according to the design of the shoe, and the preference of wearers who may have different needs and requirements. Regardless of the shoe style, the opening mechanism may be pulled at an angle towards connection area at the front and then across the entire front of the shoe thus allowing the entire front and top of the shoe to open away much like a flap.

This configuration or platform can be utilized for any and all shoe styles, from sneakers to boots to heels to dress shoes. While most of the accompanying drawings show for the most part a zipper configuration, it is not the only configuration that is available or may be used.

When a person has a disability, either from birth or by accident at some point in life, their needs tend to be viewed through a medical filter only. For example, a person who may have suddenly lost muscular control of his lower extremities would continue to desire normal and conventional comforts, as well as clothing and shoes which may be fashionable and stylish. These needs would not diminish, but often the emphasis is on treatment and rehabilitation while normal creature comforts and preferences may sometimes be overlooked. Those in wheelchairs with limited or no muscular control of their lower extremities still have a need for well-designed and comfortable shoes, and the present invention can be used in a wide range of shoe types and designs, providing practical comfort and access without sacrificing fashion and style, and without the shoe being clearly identifiable as some type of medical device. Those that require a foot, toe, or ankle brace for structural support have an additional layer of complications with a convention shoe being a conventional shoe would need to be several sizes larger than the wearer's foot to accommodate the brace, leaving too much space in the shoe around the foot while also looking abnormally large for the persons physical size and probably drawing unwanted attention.

Therefore, a shoe constructed in accordance with the present invention allows the world of fashion and style to once again be opened up to persons who are disabled or those who are born with such disabilities.

The present invention therefore provides for a shoe which is both a medical device as well as an item of fashion, all in the same product. With this marriage of form following function pre-emptive accommodations in sizing for swelling and incorrect extremity positioning may no longer be required.

In another arena completely, it appears that parents of small children can struggle significantly with putting shoes on little feet, specifically getting little toes to be pointed straight so the shoe can be put on correctly, with the foot and toes in a natural and healthy position when inside the shoe, even more complicated if the youngster has specific health concerns that require a type of foot brace. The utility of this shoe can also be used to accommodate this struggle by removing the need for co-operation with a 2 year old.

BRIEF DESCRIPTION OF THE DRAWINGS

In the drawings:

FIGS. 16A, 16B, 16C and 16D are section views through a shoe constructed in accordance with the present invention illustrating in series the insertion of a foot which may have limited or no muscular control into the shoe.

DETAILED DESCRIPTION OF THE INVENTION

Figure 1:
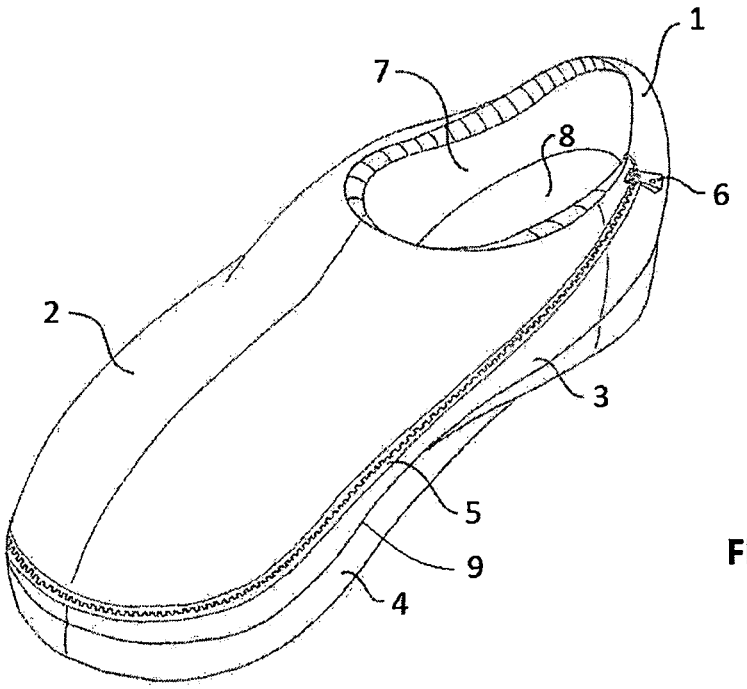
FIG. 1 is a top perspective view of a shoe in the closed position in one embodiment of the invention.

Reference is now made to the accompanying drawings which illustrate a shoe in accordance with the present invention. Note that the drawings herein show the present invention's ability to accommodate a wearer with limited foot, toe, or lower leg muscular control or feeling, as well as the wearer that additionally requires a type of foot brace for structural stability, both of these main functions of the current invention shown in the drawings can be utilized on every style of closed or partially closed shoe design, and the invention is not to be considered in any way limited or restricted to the specific embodiments illustrated herein.

Reference is now made to FIG. 1 of the drawings which shows a shoe 1 in accordance with one aspect of the invention. The shoe 1 in this drawing is one of generally conventional style and size, but is adapted and configured to open and close in a unique way to facilitate easier insertion and removal of the foot from the shoe 1. The shoe 1 comprises a top flap 2 which is mounted on a sole 4 which forms the base of the shoe 1 upon which the foot will rest when inserted in the shoe 1. The top flap 2 comprises a side and bottom 3 which is fastened to the sole 4. The shoe 1 further comprises a foot entry opening 7 and an interior 8 or space for accommodating the foot.

Figure 2:
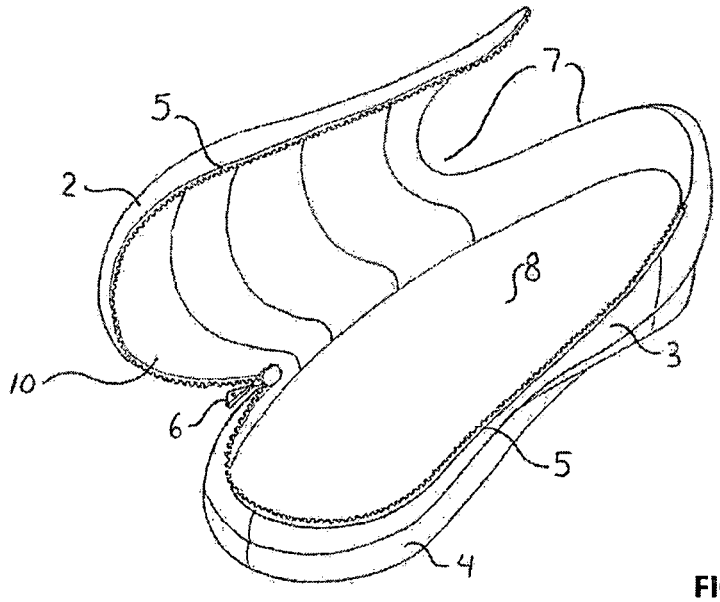
FIG. 2 is a top perspective view of the shoe illustrated in FIG. 1 of the drawings, in the open position.

A zipper 5 is formed within the top flap 2, and extends from the rim which forms part of the foot entry opening 7. As seen in FIGS. 1 and 2 of the drawings, the zipper 5 extends from a starting point at the rim of the foot entry opening 7, continues gradually downwardly along the side edge of the top flap 2, and curves around the front of the shoe 1. As best seen in FIG. 2 of the drawings, the zipper 5 thereafter extends a short way around the other side of the shoe 1.

The opening and closing of the zipper 5 has the effect of opening the shoe 1 and providing access to the interior 8 of the shoe 1 in a manner which substantially facilitates ease of putting on the shoe, but also helps to remove the foot from the shoe more easily. In effect, and as is clearly illustrated in FIG. 2 of the drawings, the top flap 2 can be bent away from the sole 4 providing almost unfettered access to the upper part of the sole 4. FIG. 1 shows the shoe 1 in the closed position in which the zipper 5 is closed, while FIG. 2 of the drawings shows the shoe 1 in the open or accessible position in which the zipper 5 has been completely unzipped to provide the simple and advantageous access as described, and enabling the foot to be placed within the shoe without having to the pushed through the foot entry opening 7. As will be described with reference to other figures herebelow, forcing the foot into the shoe through the foot entry opening 7 may twist or bend the toes, especially for a person with disabilities or young children having less control over foot muscles, inhibiting circulation and causing possible swelling and discomfort.

FIG. 2 of the drawings shows that the top flap 2 can be opened or moved away from the upper part of the sole 4 by any desired amount, revealing and exposing the underside 10 of the top flap 2. In this position, the shoe 1 is also in a much better position to facilitate airing and cleaning, as may be desired by the user.

The embodiment illustrated in FIGS. 1 and 2 show a shoe 1 which does not have laces or a tongue. In this embodiment, the opening 7 is provided for the foot to enter and the upper part of the sole 4 receives the foot. The zipper is exposed, and easily operated by a zipper tab 6 to open and close the shoe 1. While the zipper 5 is exposed in this embodiment, the zipper may be such a style that hides itself within its own design. Additionally, it is certainly within the scope of the present invention that the zipper 5 may be positioned in any convenient location on the shoe so as to give effect to the objective of the invention, namely, to provide a shoe where the top flap 2 can be moved relative to the sole 4 to provide the additional access, as described.

In the illustration shown in FIG. 2 of the drawings, a user would typically insert the foot in the shoe by first placing the heel of the foot near the open front end, and either sliding the foot backward over the upper surface of the sole 4, or sliding the shoe itself under the foot so that the heel of the foot moves over the upper surface of the sole 4 until it reaches the back of the shoe. With the foot properly and easily located in this way, the zipper 5 can be closed to fasten the top flap 2 to the sole 4 as illustrated in FIG. 1, with the foot comfortably and naturally positioned within the shoe without distorting the foot.

Figure 3:
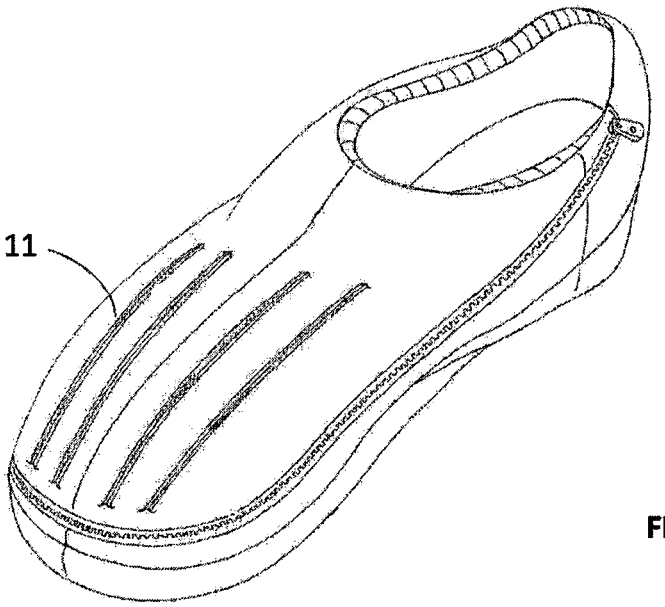
FIG. 3 is a top perspective view of the shoe, in the closed position, with several self-expanding vent area in the top member incorporated in a front to back position, those vent areas being in a tight unstretched state, in accordance with a further aspect of the invention.

Reference is now made to FIG. 3 of the drawings which shows the current invention from FIG. 1 configured with several additional self-expanding vent areas 11 running front to back along the top flap and are shown in an unstretched position, these vents allow for a wearer with any type of foot brace to utilize a shoe that is sized for their foot while the self-expanding vent areas 11 will conform as needed to accommodate any additional space a brace may require.

Figure 4:
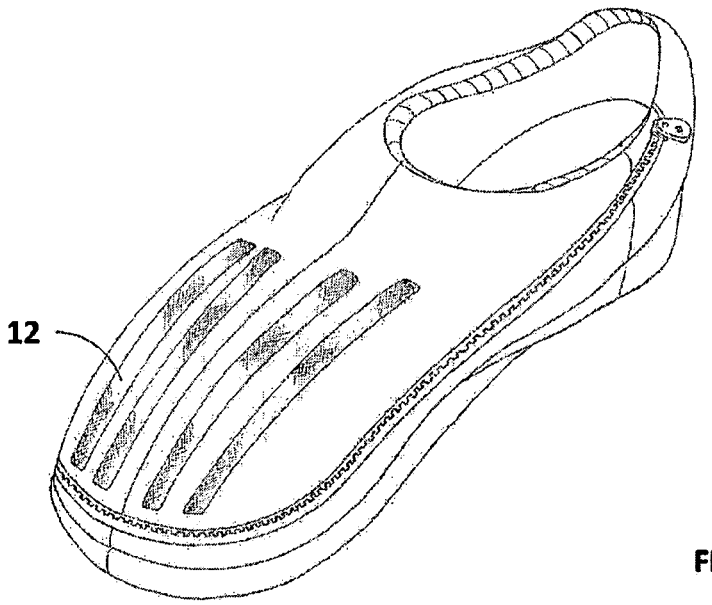
FIG. 4 is a top perspective view of the shoe, in the closed position, with several self-expanding vent area in the top member incorporated in a front to back position, those vent areas being in an expanded state, in accordance with a further aspect of the invention.

Reference is now made to FIG. 4 of the drawings which shows the current invention from FIG. 3 configured with several additional self-expanding vent areas 12 running front to back along the top flap and are shown in an expanded position creating additional interior space for a specific type of brace while allowing the wearer the correct size shoe for the foot instead of having to utilize a larger size to accommodate a brace.

Figure 5:
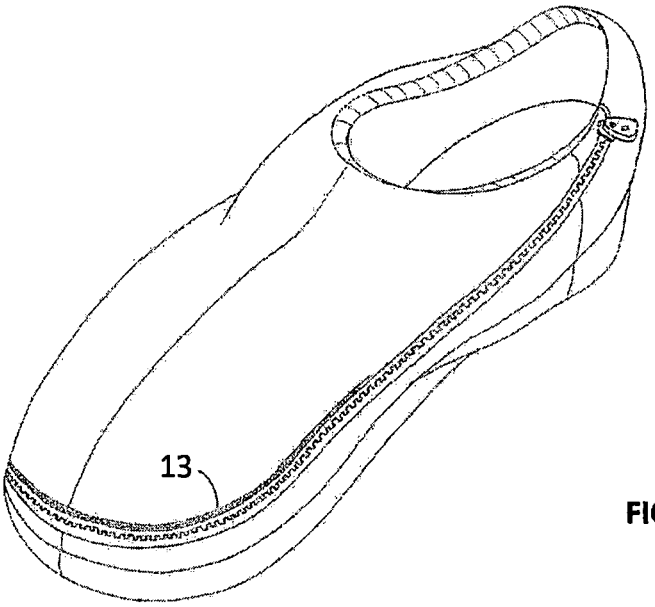
FIG. 5 is a top perspective view of the shoe, in the closed position, with a single self-expanding vent area positioned along the zipper fastener path, above the zipper fastener, and running around the entire front toe end position of the top member of the shoe, the vent area being in a tight unstretched state, in accordance with a further aspect of the invention.

Reference is now made to FIG. 5 of the drawings which shows the current invention from FIG. 1 configured with a self-expanding vent area 13 positioned just above the zipper fastener in an unstretched state, starting forward of the foot entry opening and traversing towards and around the front of the shoe and partially along the other side of the shoe ending before the zipper termination point, allowing for additionally space to be available internally for a specific type of foot brace without requiring a larger size shoe than the wearer requires.

Figure 6:
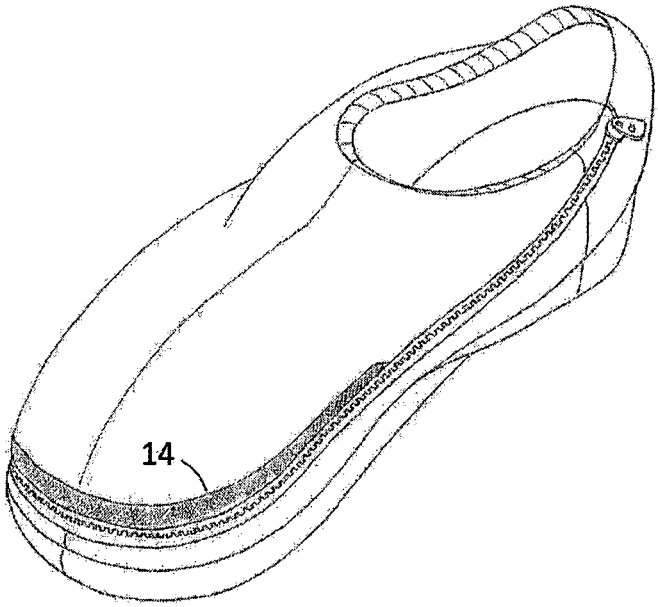
FIG. 6 is a top perspective view of the shoe, in the closed position, with a single self-expanding vent area positioned along the zipper fastener path, above the zipper fastener, and running around the entire front toe end position of the top member of the shoe, the vent area being in an expanded state, in accordance with a further aspect of the invention.

Reference is now made to FIG. 6 of the drawings which shows the current invention from FIG. 5 configured with a self-expanding vent area 14 positioned just above the zipper fastener in an expanded state, starting forward of the foot entry opening and traversing towards and around the front of the shoe and partially along the other side of the shoe ending at or before the zipper termination point, allowing for additionally space to be available internally for a specific type of foot brace without requiring a larger size shoe than the wearer requires.

Figure 7:
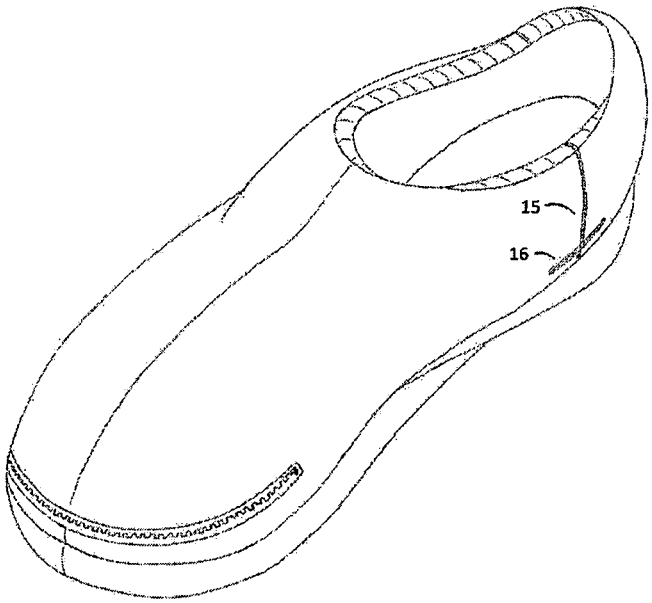
FIG. 7 is a top perspective view of the shoe, in the closed position viewed from the opposite side of the foot opening that incorporates the zipper fastener starting position, with a vertical limited expansion self-expanding vent and a horizontal limited expansion self-expanding vent, both vents in a unstretched state, in accordance with a further aspect of the invention.

Reference is now made to FIG. 7 of the drawings which shows the current invention from FIG. 1 configured with a vertical self-expanding vent area 15 and a horizontal self-expanding vent area 16 positioned on the opposite side of the foot entry opening that incorporates the zipper fastener starting point, the horizontal vent 16 located just above the connection area and the vertical vent 15 located in the midline of the horizontal vent. Both vents are in an unstretched state and positioned within the top member to accommodate a specific type of brace that requires a smaller amount of additional space only in a certain area allowing the wearer of a foot brace to utilize the correct size shoe for their foot instead of buying an oversized shoe to accommodate their brace.

Figure 8:
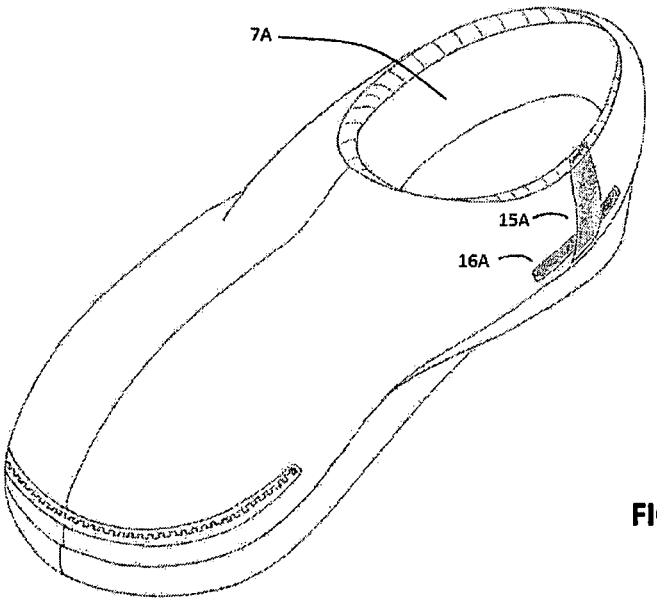
FIG. 8 is a top perspective view of the shoe, in the closed position viewed from the opposite side of the foot opening that incorporates the zipper fastener starting position, with a vertical limited expansion self-expanding vent and a horizontal limited expansion self-expanding vent, both vents in an expanded state, in accordance with a further aspect of the invention.

Reference is now made to FIG. 8 of the drawings which shows the current invention from FIG. 7 configured with a vertical self-expanding vent area 15A and a horizontal self-expanding vent area 16A positioned on the opposite side of the foot entry opening that incorporates the zipper fastener starting point, the horizontal vent 16A located just above the connection area and the vertical vent 15A located in the midline of the horizontal vent. Both vents are in an expanded state and positioned within the top member to accommodate a specific type of brace that requires additional space only in a certain area allowing the wearer of a foot brace to utilize the correct size shoe for their foot instead of buying an oversized shoe to accommodate their brace.

Figure 9:
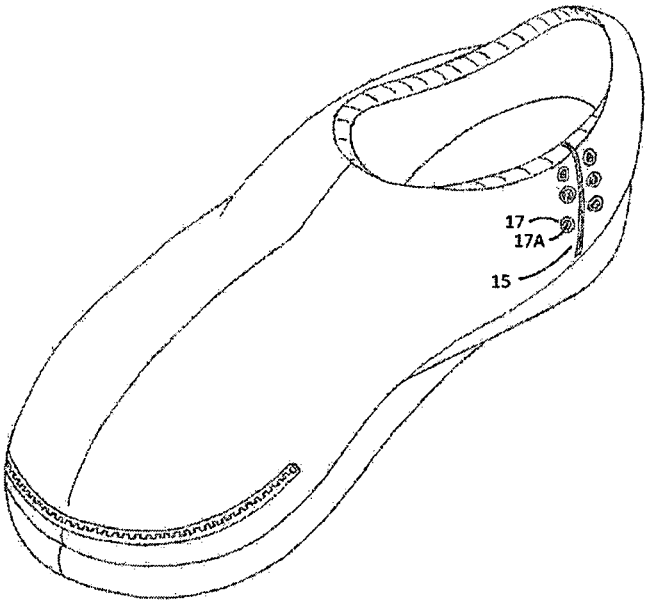
FIG. 9 is a top perspective view of the shoe, in the closed position viewed from the opposite side of the foot opening that incorporates the zipper fastener starting position, with a vertical self-expanding vent in an unstretched state, and lace holes for threading a lace to limit the amount of expansion when used, in accordance with a further aspect of the invention.

Reference is now made to FIG. 9 of the drawings which shows the current invention from FIG. 1 configured with a vertical self-expanding vent area 15 with lacing holes 17 located on either side of the vertical vent area 15, the vent positioned on the opposite side of the foot entry opening that incorporates the zipper fastener starting point. The vent is in an unstretched state and positioned within the top member to accommodate a specific type of brace that requires a larger amount of additional space only in a certain area allowing the wearer of a foot brace to utilize the correct size shoe for their foot instead of buying an oversized shoe to accommodate their brace.

Figure 10:
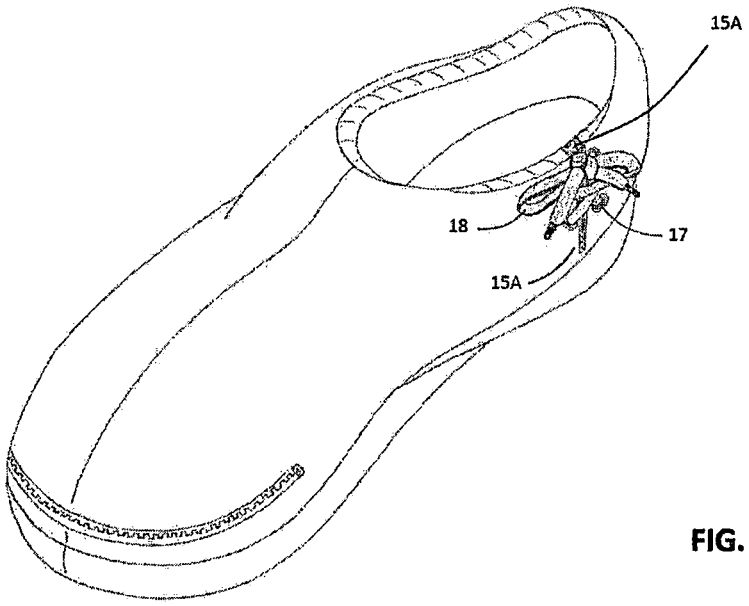
FIG. 10 is a top perspective view of the shoe, in the closed position viewed from the opposite side of the foot opening that incorporates the zipper fastener starting position, with a vertical self-expanding vent in an expanded state, with a lace used to adjust the amount of expansion of the vent, in accordance with a further aspect of the invention.

Reference is now made to FIG. 10 of the drawings which shows the current invention from FIG. 9 configured with a vertical self-expanding vent area 15A with lacing holes 17 located on either side of the vertical vent area 15A and a standard type shoe lace 18 controlling the amount of expansion the vent area allows while offering structural stability to the foot entry opening, the vent positioned on the opposite side of the foot entry opening that incorporates the zipper fastener starting point. The vent 15A is in an expand state and controlled by the shoe lace 18 tying the vent area snug to any accommodated larger size foot brace, and allowing the wearer of a foot brace to utilize the correct size shoe for their foot instead of buying an oversized shoe to accommodate their brace.

Reference is now made to FIG. 11 of the drawings which shows the current invention from FIG. 1 from a rear view configured with a vertical self-expanding vent area 19 in the center of the heel portion 22 of the shoe in an unstretched state, the vent allows for additional space in a specific area of the shoe to accommodate a specific type of foot brace allowing the wearer to buy the correct size show for their foot size and not a larger shoe to accommodate a foot brace.

Figure 11A:
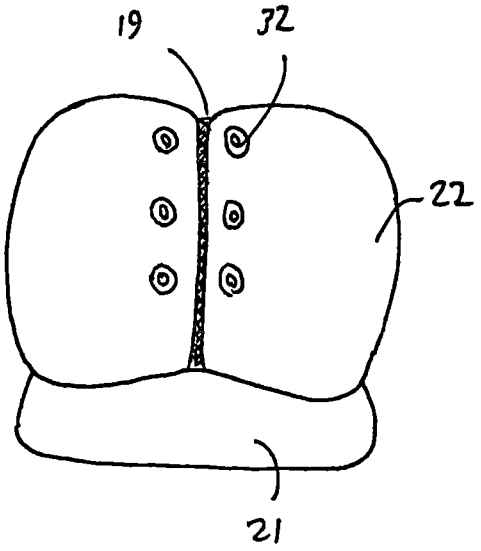
FIG. 11 is a rear perspective of the shoe, in the closed position, with a vertical self-expanding vent positioned in the center of the rear of the shoe in an unstretched state, in accordance with a further aspect of the invention.

Reference is now made to FIG. 11A of the drawings which shows the current invention from FIG. 11 from a rear view configured with a vertical self-expanding vent area 19 in the center of the heel portion 22 of the shoe in an unstretched state, the vent allows for additional space in a specific area of the shoe to accommodate a specific type of foot brace allowing the wearer to buy the correct size show for their foot size and not a larger shoe to accommodate a foot brace, additionally there are lacing holes 32 to accept a shoe lace to further adjust the foot entry opening fitment.

Reference is now made to FIG. 12 of the drawings which shows the current invention from FIG. 11 from a rear view configured with a vertical self-expanding vent area 20 in the center of the heel portion 22 of the shoe in an expanded state, the vent allows for additional space in a specific area of the shoe to accommodate a specific type of foot brace allowing the wearer to buy the correct size show for their foot size and not a larger shoe to accommodate a foot brace, additionally there are lacing holes 32 to accept a shoe lace 33 to further adjust the foot entry opening fitment.

Figure 12A:
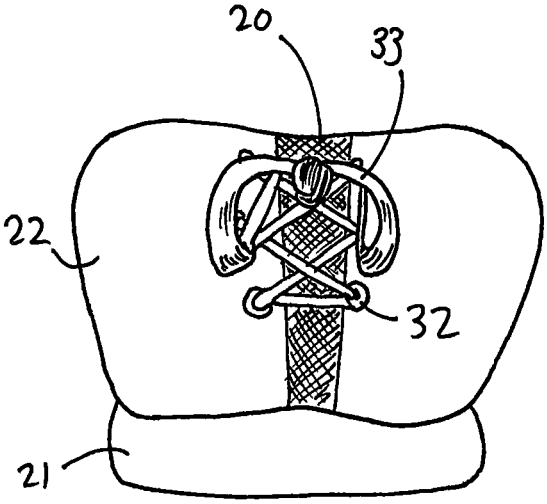
FIG. 12 is a rear perspective of the shoe, in the closed position, with a vertical self-expanding vent positioned in the center of the rear of the shoe in an expanded state, in accordance with a further aspect of the invention.

Reference is now made to FIG. 12A of the drawings which shows the current invention from FIG. 11A from a rear view configured with a vertical self-expanding vent area 20 in the center of the heel portion 22 of the shoe in an expanded state, the vent allows for additional space in a specific area of the shoe to accommodate a specific type of foot brace allowing the wearer to buy the correct size show for their foot size and not a larger shoe to accommodate a foot brace.

Figure 13:
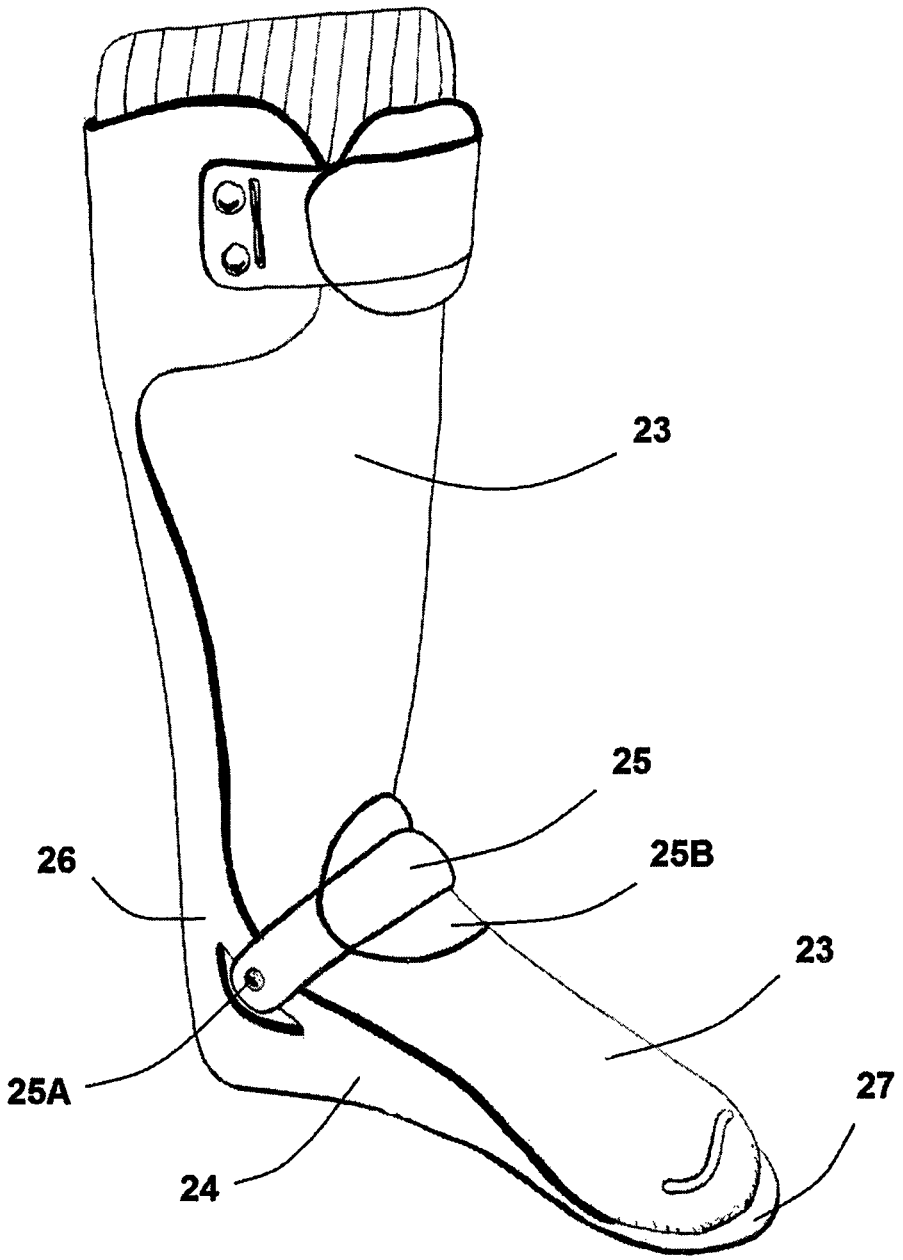
FIG. 13 is a side view of a foot brace structurally supporting the ankle.

Reference is now made to FIG. 13 of the drawings which shows a foot/ankle brace 24 worn prior to being placed in a shoe, the brace having material covering the bottom of the wearer's foot 27 and covering the heel area 26 as well as a strap 25 and pad 25B across the front of the wearer's ankle joint area. This additional material causes a wearer to buy a larger size shoe than their foot requires so specific areas inside the shoe have enough room to accommodate the brace, unfortunately the entirety of the shoe in all areas is too large for the wearer in this situation. The current invention allows for ease of entry into the shoe with a brace attached to the wearer's foot as well as additional adjustment options, such as those in FIGS. 7-12, that allow the shoe to mold around the brace while the remaining areas of the shoe stay a correct sizing and fit to the wearer's foot, this also allows for a stylish shoe to remain a stylish shoe and not attract attention as a medical device looking shoe.

Figure 14:
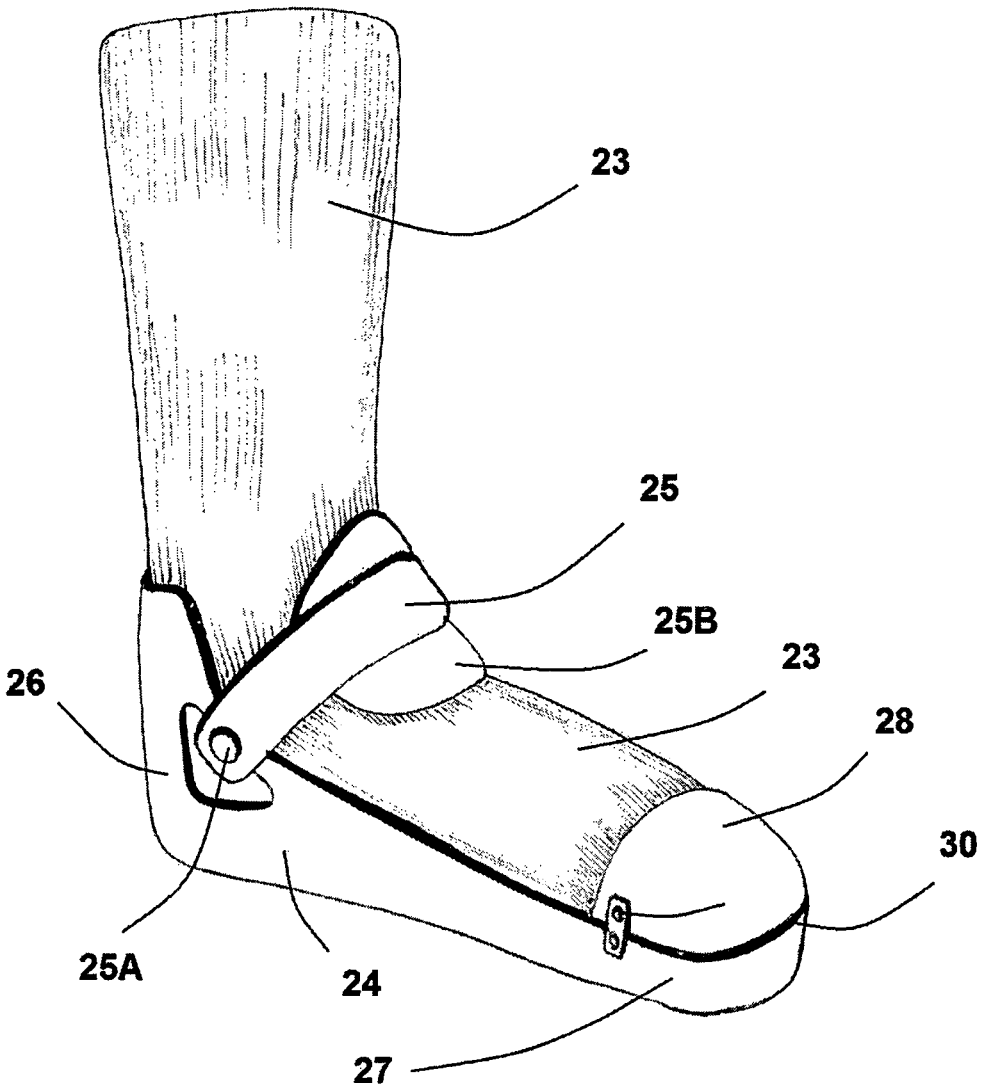
FIG. 14 is a side view of a foot brace structurally supporting an ankle and protecting toes.

Reference is now made to FIG. 14 of the drawings which shows a foot/ankle brace 24 being worn prior to being placed in a shoe, the brace having material covering the bottom of the wearer's foot 27 and covering the heel area 26 as well as a strap 25 and pad 25B across the front of the wearer's ankle joint area, additionally the brace has a toe protection cap 28 utilized after treatments and surgery. This additional material causes a wearer to buy a larger size shoe than their foot requires so specific areas inside the shoe have enough room to accommodate the brace, unfortunately the entirety of the shoe in all areas is too large for the wearer in this situation. The current invention allows for ease of entry into the shoe with a brace attached to the wearer's foot as well as additional adjustment options, such as those in FIGS. 7-12 for the general type of ankle brace 26 shown in FIG. 13 and additional adjustment options for the toe cap protection brace 28 in FIGS. 3-6, that allow the shoe to mold around the brace while the remaining areas of the shoe stay a correct sizing and fit to the wearer's foot, this also allows for a stylish shoe to remain a stylish shoe and not attract attention as a medical device looking shoe. FIGS. 3-6 adjustment option vents are designed with injury treatment rehabilitation ease in mind.

Figure 15A:
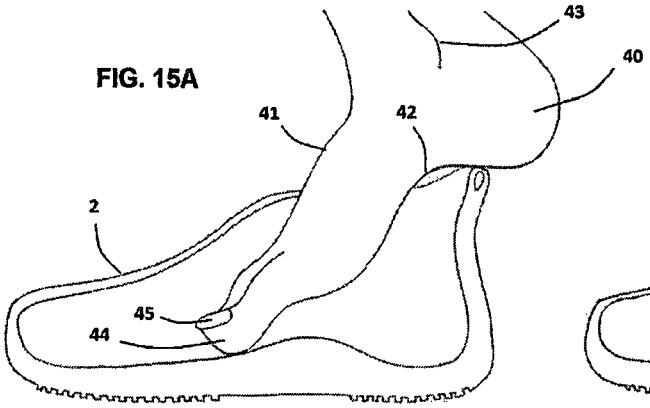
FIGS. 15A, 15B, 15C and 15D are section views through a shoe of conventional style illustrating in series the insertion of a foot which may have limited or no muscular control into the shoe.
Figure 15B:
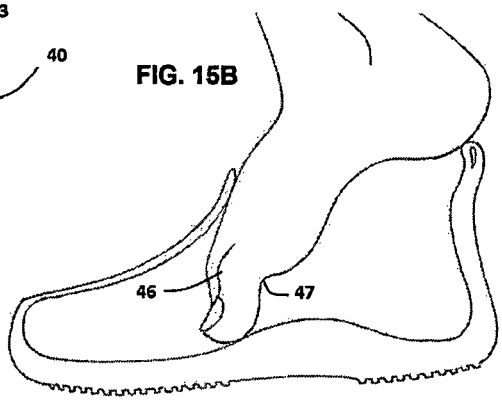
Figure 15C:
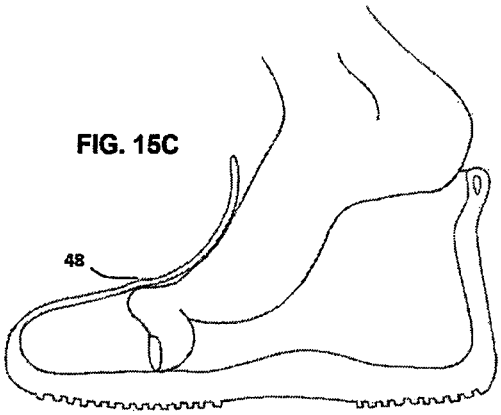
Figure 15D:
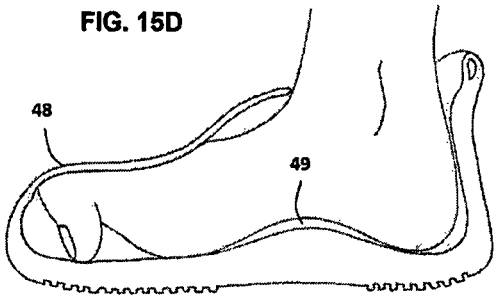

FIGS. 15A, 15B, 15C and 15D of the drawings show a cross-section through a conventional shoe, and illustrates some of the difficulties that may result when a person who may be disabled or paralyzed tries to push the foot into the shoe through the opening. FIG. 15A shows a foot having a heel 40, arch 42, top 41, ankle bone 43, big toe 44 and toenail 45. The big toe 44 has a top side of the first joint 46 and a bottom of the first joint 47. The initial placement of the foot in the shoe through the opening continues normally until the opening of the shoe constrains the top of the foot 41 and the heel 40, which is located over the back of the shoe. By further forcing the foot into the shoe, as illustrated in FIG. 15B, the big toe 44 and other toes do not move easily, and the top of the foot 41 curves around. As seen in FIG. 15C, further forcing of the foot into the shoe causes the big toe to become bent or curled into an unnatural position, and FIG. 15D shows the foot inserted in the shoe with the toe hooked in an unnatural and uncomfortable position. Disabled or paralyzed persons would not have the ability to feel that the foot has been incorrectly placed in the shoe, but there may nevertheless be associated discomfort, swelling, as well as a reduction in circulation which may cause pain and even bruising.

FIG. 15 therefore illustrates the situation where a foot having no muscular control is being pushed into a normal shoe, and the subsequent effect on the toes, the arch, and the top of the foot. The foot becomes cramped and distorted within the shoe, and the toenail may be loosened or injured from rubbing the insole. The end of the toe can become calloused, and the big toe joints may rub up against the shoe 48 due to the absence of space, while the arch of the foot is also bent in such a way that the bottom of the foot does not make proper contact with the top of the sole of the shoe creating a space 49 that allows for internal movement and irritation. The joint in the big toe as well as all of the other toes are bent, impeding proper blood flow which may cause the swelling as mentioned above, leading to deterioration of the toe and foot tissue.

FIGS. 16A, 16B, 16C and 16D of the drawings illustrates the situation where a foot having no muscular control may be more easily and comfortably inserted in a shoe constructed in accordance with the present invention. In FIG. 16A, with the top flap 2 in the open or unzipped position, the heel 40 of the foot is placed on the interior bottom of the shoe 8 at the front end thereof, and to which there is easy access. The shoe can then be moved forward in the direction of the arrow 100B, and/or the foot moved rearwardly in the direction of the arrow 100A. FIG. 16B shows an intermediate position with the heel 40 of the foot moving rearwardly towards the back of the shoe 101, while FIG. 16C shows the foot in the near completed position and the toes in their natural relaxed and flat position moving easily onto the interior bottom of the shoe 8. Finally, in FIG. 16D, the shoe is comfortably positioned around the foot, with the ankle 43, arch 42, heel 40, and toes/big toe 46 in a natural relaxed and flat position, and the top flap 2 is closed by closing the zipper 5 to capture and hold the foot snugly within the shoe. With the shoe of the invention, being put on the foot in the manner sequentially illustrated in FIGS. 16A, 16B, 16C and 16D of the drawings, there is little possibility of distortion, cramping or scrunching of the foot and toes. The health of the foot would therefore be preserved, and proper blood circulation can be achieved, while any swelling of the foot can be readily avoided or reduced.

FIG. 16 therefore clearly illustrates the effectiveness and operation of the reverse entry shoe, allowing the toes to maintain the straight joints that are important for robust circulation and tissue health. When the toes are rolled under the foot, such as shown in FIG. 15D, the entire skeletal structure of the foot changes, the arch 42 rises 49, and the top of the foot abuts against the top and tongue of the shoe causing an unnatural hump to the shape of the foot. This result can be readily and conveniently avoided entirely when a shoe constructed in accordance with the present invention is used.

Figure 17:
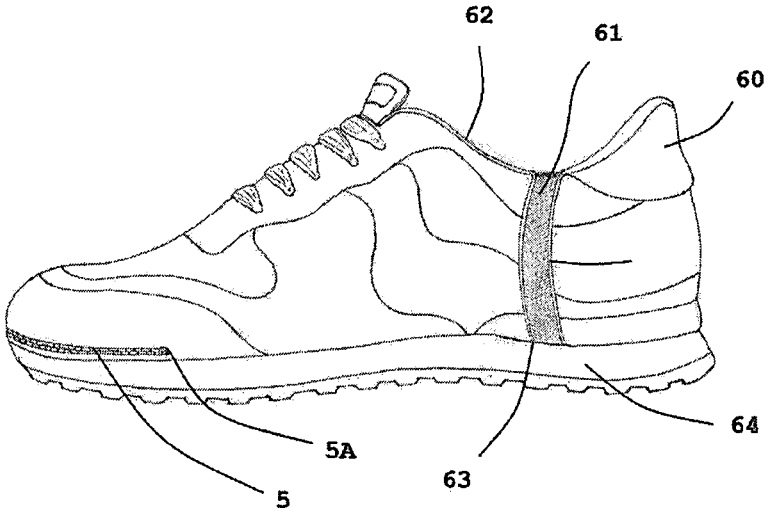
FIG. 17 is a side view detailing the vertical self-expanding stretch band down the side of the ankle opening on the opposite side of the fastening means, also shown is the zipper termination point.

FIG. 17 illustrates the outer side of the shoe 60 with a self-expanding vertical band 61 which starts at the top of the ankle/foot opening 61 and ends and the connection area 63 to the sole 64, the zipper fastener 5 and the zipper termination point 5A is also shown. The vertical band 61 is shown without the securement cover flap which controls the structure of the ankle/foot opening once accommodating a foot brace.

Figure 18:
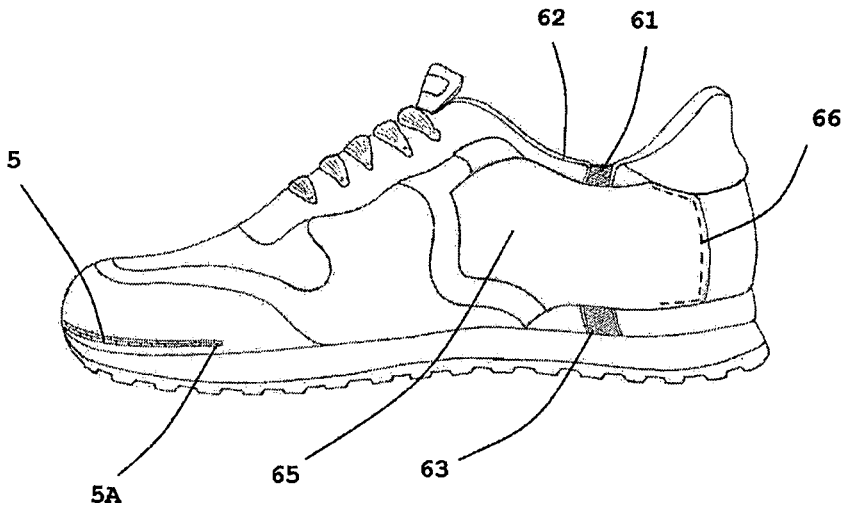
FIG. 18 details a side view of a cover flap which secures the self-expanding area once that area has adjusted to suit the wearers brace spatial needs inside the shoe.

FIG. 18 shows the securement cover flap 65 attached at the rear of the flap 66 and covering the majority of the self-expanding vertical band 61 and designed to blend with the artistic flow of the shoe. The upper portion of the expandable band 61 where it reaches the top edge of the ankle opening 62 and the lower portion of the expandable band 61 where it reaches the sole 63 is exposed. The zipper fastener 5 and zipper termination point 5A are also detailed.

Figure 19:
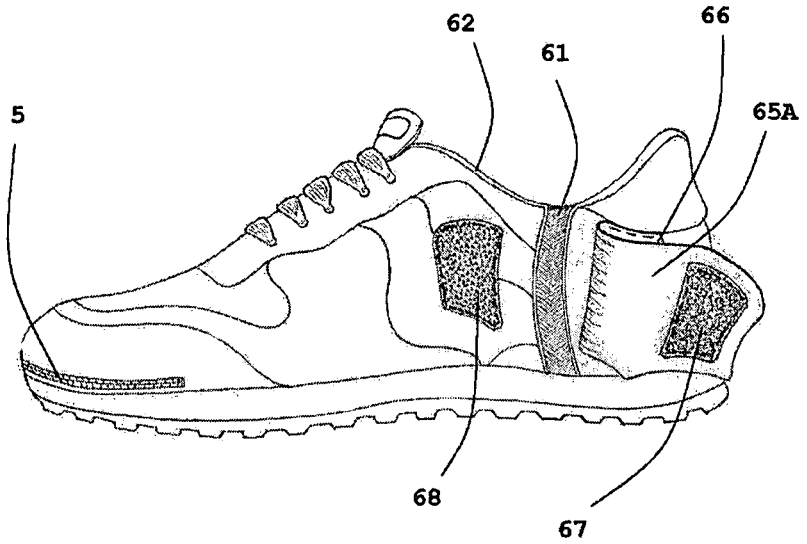
FIG. 19 shown in side view details the cover flap in the open position exposing the fastening means and the self-expanding material.

FIG. 19 details the securement cover flap 65 in the open position and exposing the inner side of the securement cover flap 65A, the cover flap 65 attached at the rear end 66, showing the female side 67 of the hook and loop attachment means, also shown is the male side 68 of the hook and loop attachment means secured to the side of the top member and forward of the self-expanding vertical band 61. The securement flap 65 when engaged crosses over the self-expanding band 61 and pulled tight to secure the ankle opening when the female side 67 of the hook and loop attachment means attaches to the male side 68 of the hook and loop attachment means. The size of the hook and loop patches allows for a multitude of adjustments to accommodate a multitude of brace sizes inside the ankle/foot opening 62.

Figure 20:
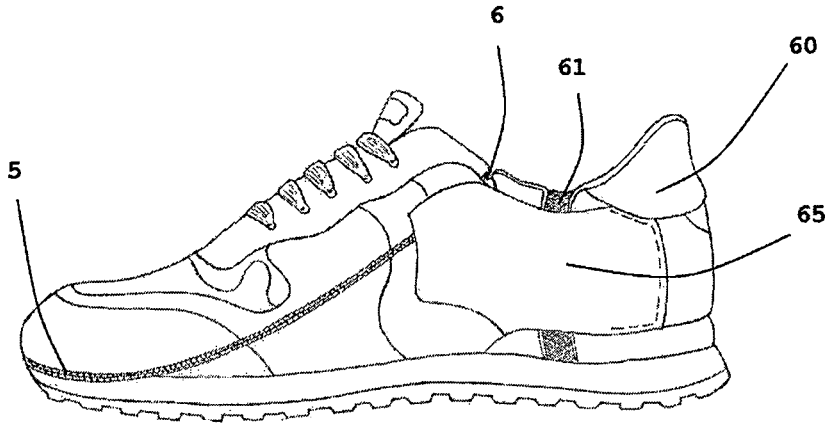
FIG. 20 shown in side view describes the self-expanding vertical band on the same side of the ankle opening as the starting position of the zipper fastening means, as well as the cover flap which also covers a portion of the zipper itself.

FIG. 20 showing the self-expanding vertical band 61 on the same side as the zipper fastener 5 opening point. The securement cover flap 65 in closed position securing the structural support of the ankle/foot opening 62 by way of the male and female hook and loop attachment means engaging between the cover flap 65 and the side of the top member 60.

Figure 21:
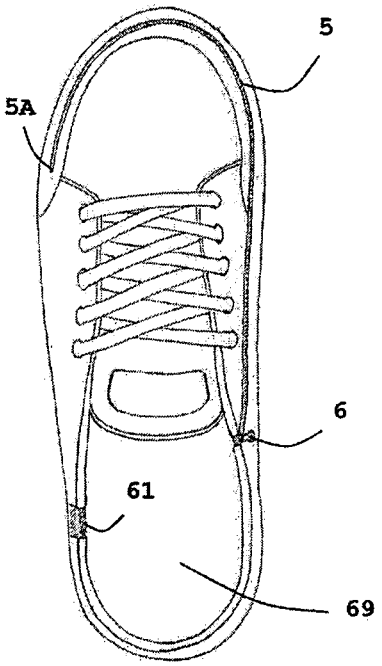
FIG. 21 shown in top view shows the zipper fastener on one side of the ankle opening and the self-expanding material on the other side. The self-expanding material in the non-expanded position with the ankle opening's shape taking a normal shape.

FIG. 21 shown from the top without the securement cover flap details the self-expanding vertical band 61 on the outer side of the shoe and the zipper fastener 5 beginning on the inner side of the shoe and traversing the front toe portion to the zipper termination point 5A on the outer side of the shoe. The ankle/foot opening width 69 revealed in the normal shape with the expanded band 61 in a relaxed state. The zipper pull tab 6 is also detailed.

Figure 22:
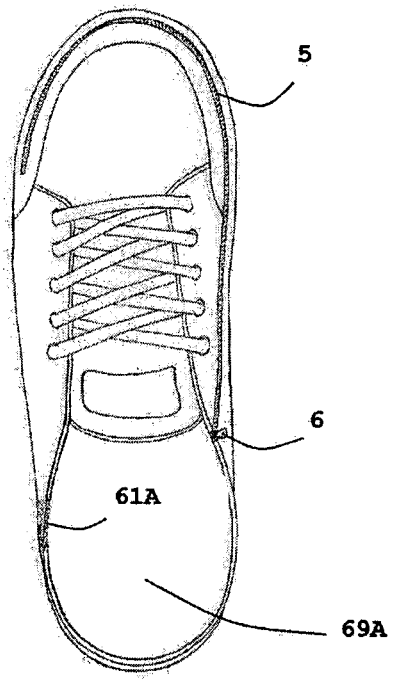
FIG. 22 shown in top view shows the zipper fastener on one side of the ankle opening and the self-expanding material on the other side. The self-expanding material in the expanded position with the ankle opening's shape taking a shape that is increased in size to a normal ankle opening shape.

FIG. 22 shown from the top without the securement cover flap details the self-expanding vertical band 61 on the outer side of the shoe and the zipper fastener 5 beginning on the inner side of the shoe and traversing the front toe portion to the zipper termination point 5A on the outer side of the shoe. The ankle/foot opening width 69 revealed in an enlarged shape 69A as when accommodating a foot brace, with the expanded band 61 in an expanded state 61A.

Figure 23:
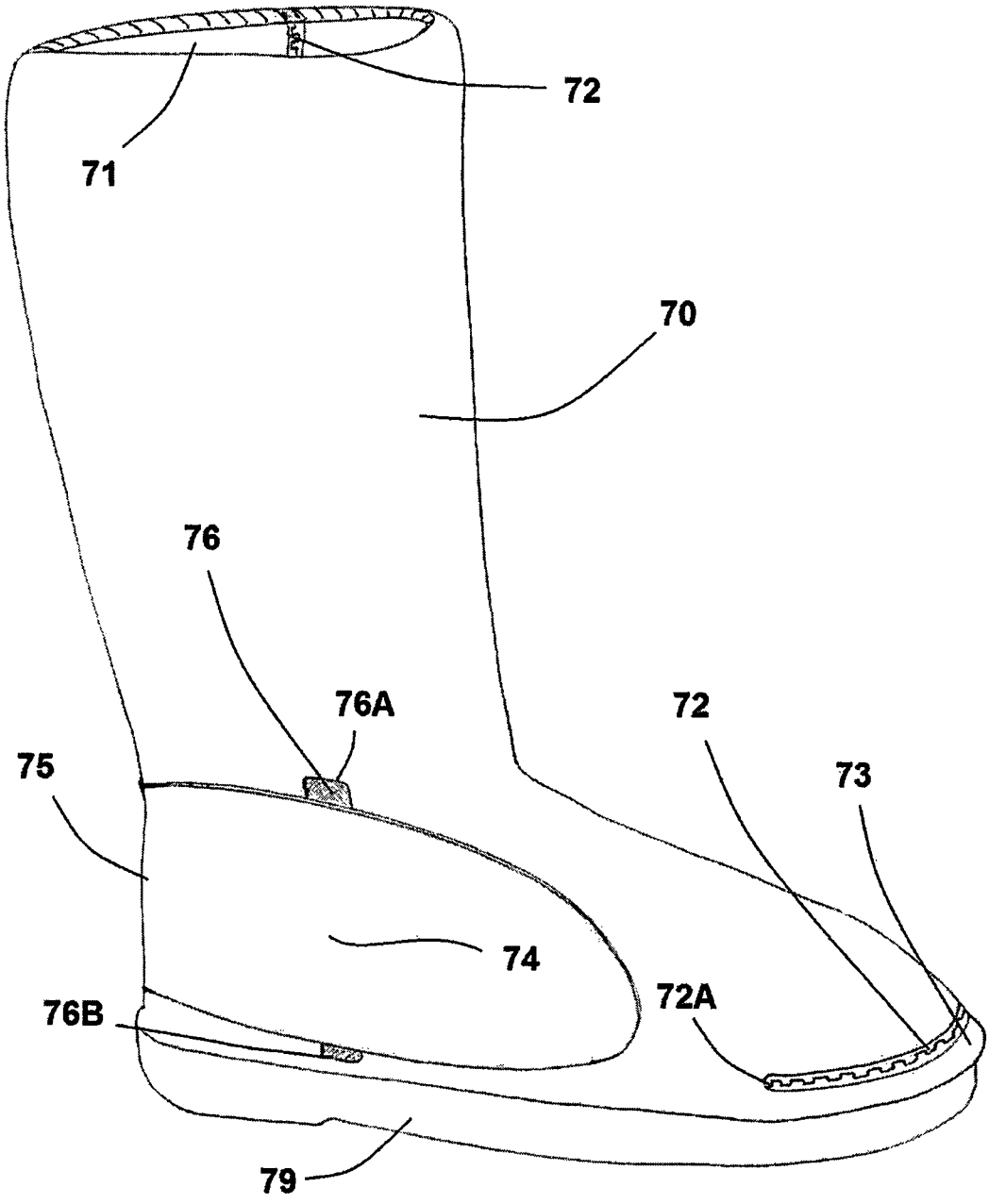
FIG. 23 shown in side view is a tall boot style details a side view of a cover flap which secures the self-expanding area once that area has adjusted to suit the wearers brace spatial needs inside the shoe.

FIG. 23 Shown from a side angle is a tall boot style shows the securement cover flap 74 attached at the rear of the flap 75 and covering the majority of the self-expanding vertical band 76 and designed to blend with the artistic flow of the shoe. The upper portion of the expandable band 76 where it reaches near the top of the ankle placement area 76A and the lower portion of the expandable band 76B where it reaches the sole 79 is also exposed. The top edge of the extended length zipper fastener 72 and zipper termination point 72A are also detailed.

Figure 24:
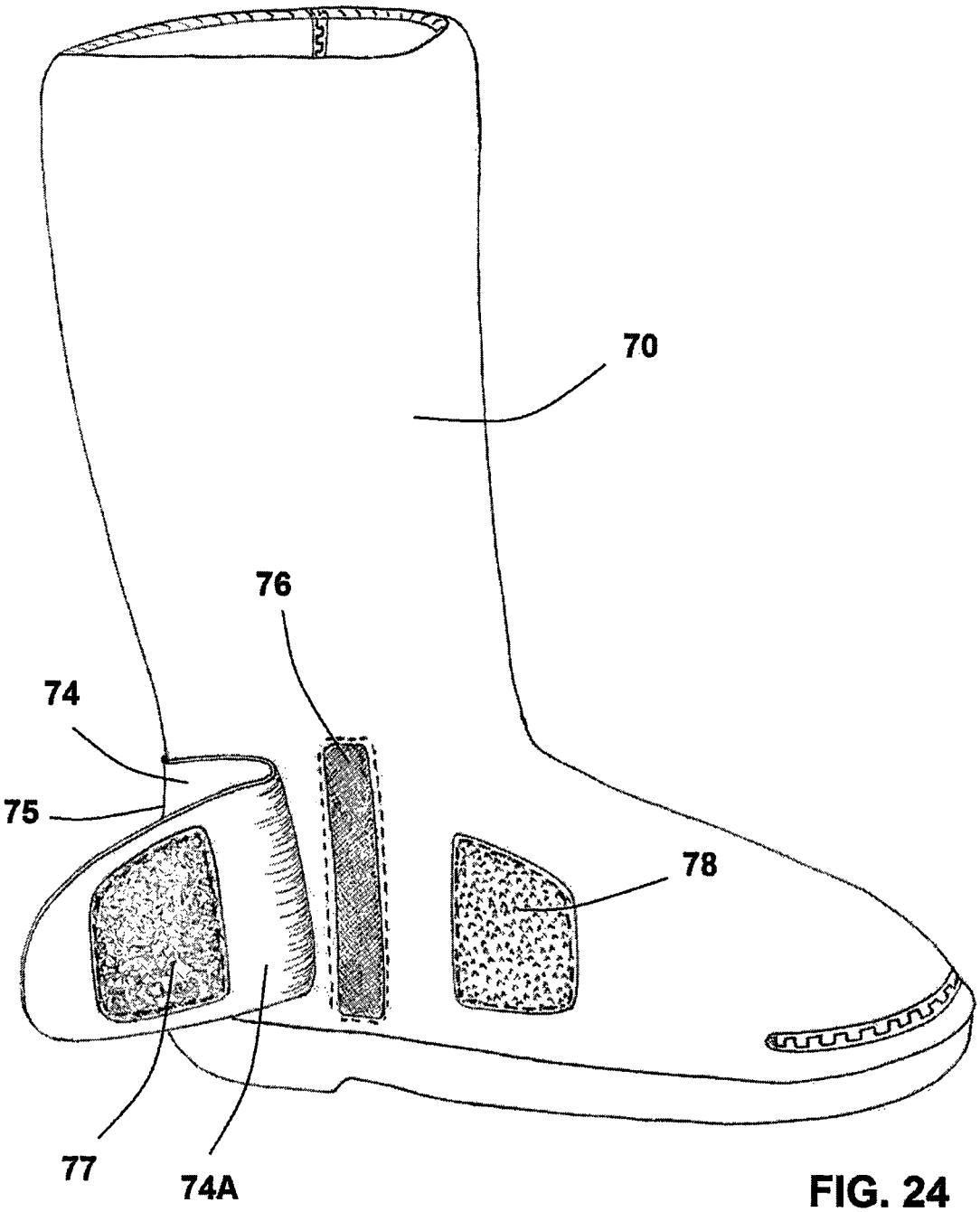
FIG. 24 shown in side view is a tall boot style shown in side view details the cover flap in the open position exposing the fastening means and the self-expanding material.

FIG. 24 Shown from a side angle is a tall boot style and shows the securement cover flap 74 in the open position and exposing the inner side of the securement cover flap 74A, the cover flap 74 attached at the rear end 75, showing the female side 77 of the hook and loop attachment means, also shown is the male side 78 of the hook and loop attachment means secured to the side of the top member 70 and forward of the self-expanding vertical band 76. The securement flap 74 when engaged crosses over the self-expanding band 76 and pulled tight to secure the ankle area when the female side 77 of the hook and loop attachment means attaches to the male side 78 of the hook and loop attachment means. The size of the hook and loop patches allows for a multitude of adjustments to accommodate a multitude of brace sizes inside the ankle area of the top member 70.

Figure 25:
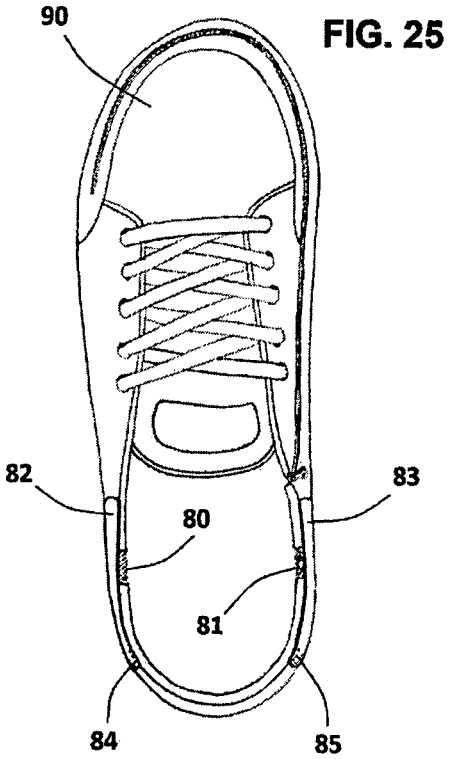
FIG. 25 shown in top view a sneaker type shoe having a self-expanding vertical band and securement cover flaps installed on both sides of the top member.

FIG. 25 shown from the top detailing the self-expanding vertical bands 80, 81 and securement cover flaps 82, 83 securing the self-expanding vertical bands 80, 81. The securement cover flaps permanently attached 84, 85 to the top member at the proximal heel portion of the top member.

Figure 26:
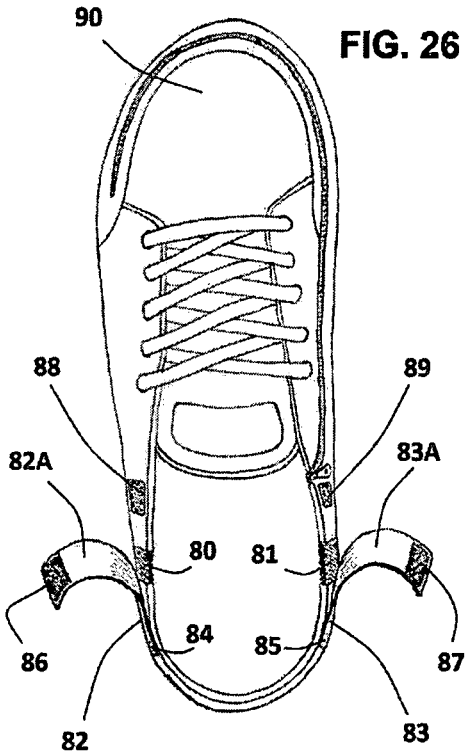
FIG. 26 shown in top view a sneaker type shoe having a self-expanding vertical band and securement cover flaps installed on both sides of the top member.

FIG. 26 shown from the top detailing the self-expanding vertical 80, 81 bands unsecured by the securement cover flaps 82, 83 and further showing the inner sides of the securement cover flaps 82A, 83A each with the male side of a hook and loop material 86, 87 at the distal end of the flap and a permanent attachment at the proximal end of the flap 84, 85. Also shown is the female side of the hook and loop material 88, 89 mounted on each side of the top member and on the distal side of the self-expanding vertical bands 82, 83.

Figure 27:
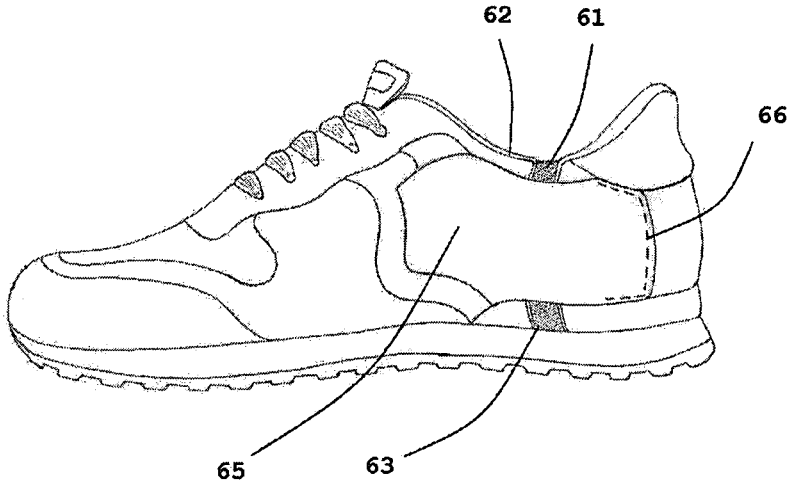
FIG. 27 details a side view of a cover flap which secures the self-expanding area once that area has adjusted to suit the wearers brace spatial needs inside the shoe.

FIG. 27 shows the securement cover flap 65 attached at the rear of the flap 66 on the proximal side of the self-expanding band 61 and covering the majority of the self-expanding vertical band 61 and designed to blend with the artistic flow of the shoe. The upper portion of the expandable band 61 where it reaches the top edge of the ankle opening 62 and the lower portion of the expandable band 61 where it reaches the sole 63 is exposed.

Figure 28:
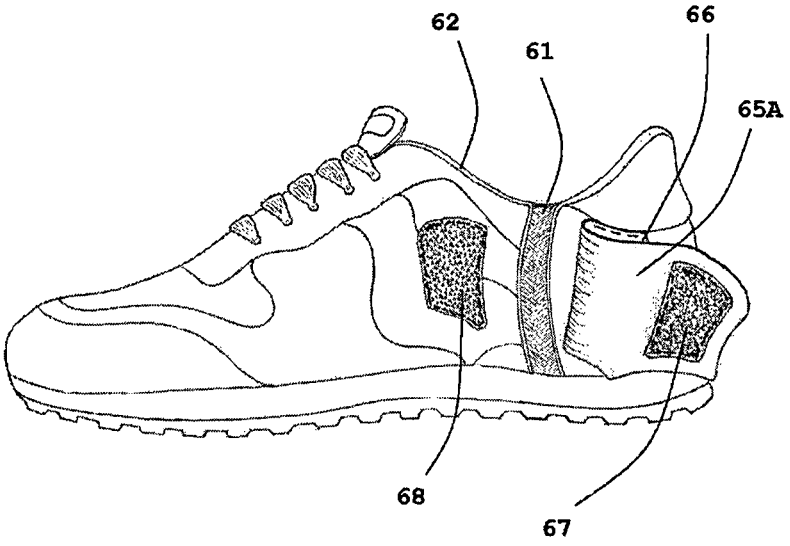
FIG. 28 shown in side view details the cover flap in the open position exposing the fastening means and the self-expanding material.

FIG. 28 details the securement cover flap 65 in the open position and exposing the inner side of the securement cover flap 65A, the cover flap 65 attached at the rear end 66, showing the female side 67 of the hook and loop attachment means, also shown is the male side 68 of the hook and loop attachment means secured to the side of the top member on the dorsal side of the self-expanding vertical band 61. The securement cover flap 65 when engaged crosses over the self-expanding band 61 and pulled tight to secure the ankle opening when the female side 67 of the hook and loop attachment means attaches to the male side 68 of the hook and loop attachment means. The size of the hook and loop patches allows for a multitude of adjustments to accommodate a multitude of brace sizes inside the ankle/foot opening 62.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

The invention claimed is:

1. A method for a shoe to accommodate an ankle brace consisting of;

an expandable vertical band in the lateral side of a top member, the expandable vertical band inserted from a top member to a sole connection area to a dorsal edge of an ankle opening, the expandable vertical band allows the ankle opening to increase in size to accommodate the ankle brace, the increased ankle opening size is adjustably controlled by a securement cover flap, the securement cover flap with one end permanently attached to the lateral side of the top member on a proximal side of the expandable vertical band, the other end of the securement cover flap with a patch of a hook and loop material permanently attached, the end of the securement cover flap with the hook and loop material is securably and releasably attached to a hook and loop patch permanently attached to the lateral side of the top member on a distal side of the expandable vertical band, when the securement cover flap hook and loop patch is released from the hook and loop patch on the lateral side of the top member the expandable vertical band can expand allowing the size of the ankle opening to increase to accommodate the ankle brace, when the hook and loop patch on the securement cover flap is secured to the hook and loop patch on the lateral side of the top member further expansion of the expandable vertical band is restricted and the ankle opening structural support is increased.

2. A method for a shoe to accommodate an ankle brace consisting of;

a single fastening means in the form of a single continuous zipper fastener in a top member of the shoe, the zipper tab of the zipper fastener requiring one movement to access entry into the shoe, the zipper fastener extending from a zipper fastener starting point on a medial side of the top member at a dorsal edge of the ankle opening, traversing the medial side of the top member at a descending angle directly towards a top member to sole connection area where the medial side becomes a distal front end portion of the top member and continuing across the distal front end portion of the top member at the top member to sole connection area to where the distal front end portion becomes a lateral side of the top member and then traversing the lateral side of the top member along the top member to sole connection area towards a proximal heel end portion of the shoe to a zipper fastener termination point located on the lateral side of the top member at the top member to sole connection area between the distal front end portion of the top member and a distal end of the ankle opening, the zipper tab of the zipper fastener moved from the zipper fastener starting point to the zipper fastener termination point wherein the top flap of the top member can be movably opened configuring the top member to allow entry into the shoe, entry into the shoe by placing a heel of a user's foot on a toe portion of a top surface of an exposed sole of the shoe and sliding the foot along the top of the sole of the shoe until the heel of the foot contacts the proximal heel portion of the shoe, additionally in the top member, independent of the zipper fastener, and located in a different portion of the top member than the zipper fastener is an expandable vertical band in the lateral side of the top member, the expandable vertical band inserted from the top member to sole connection area to the dorsal edge of the ankle opening, the expandable vertical band allows the ankle opening to increase in size to accommodate the ankle brace, the increased ankle opening size is adjustably controlled by a securement cover flap, the securement cover flap with one end permanently attached to the lateral side of the top member on a proximal side of the expandable vertical band, the other end of the securement cover flap with a patch of a hook and loop material permanently attached, the hook and loop end of the securement cover flap is securably and releasably attached to a hook and loop patch permanently attached to the lateral side of the top member on a distal side of the expandable vertical band, when the securement cover flap hook and loop patch is released from the hook and loop patch on the lateral side of the top member the expandable vertical band can expand allowing the size of the ankle opening to increase to accommodate the ankle brace, the zipper tab moved from the zipper fastener termination point to the zipper fastener starting point closes and secures the top flap of the top member, the securement cover flap hook and loop end being secured to the hook and loop patch on the lateral side of the top member limits further expansion of the expandable vertical band and supports the ankle opening.

* * * * *